United States Patent [19]

Smahlik

[11] Patent Number: 4,697,296

[45] Date of Patent: Oct. 6, 1987

[54] SQUEEGEE

[75] Inventor: Michael A. Smahlik, Oakland, Calif.

[73] Assignee: Steccone Products Company, Inc., Oakland, Calif.

[21] Appl. No.: 767,171

[22] Filed: Aug. 19, 1985

[51] Int. Cl.[4] ..... A47L 13/11

[52] U.S. Cl. ..... 15/245; 15/145

[58] Field of Search ..... 15/245, 144 R:145

[56] References Cited

U.S. PATENT DOCUMENTS

| | | | |
|---|---|---|---|
| 1,478,339 | 12/1923 | Jayne . | |
| 2,123,638 | 7/1938 | Ettore Steccone | 15/245 |
| 2,440,099 | 4/1948 | Kind | 15/245 |
| 2,771,626 | 11/1956 | Toothman | 15/245 |
| 2,864,110 | 12/1958 | Bruger | 15/145 X |
| 2,905,960 | 9/1959 | Ward | 15/245 |
| 3,110,052 | 5/1961 | Whitman | 15/117 |
| 3,892,005 | 7/1975 | Berns | 15/245 |
| 4,336,624 | 6/1982 | Pichelman | 15/245 |

FOREIGN PATENT DOCUMENTS

| | | | |
|---|---|---|---|
| 86603 | 12/1921 | Austria . | |
| 7536307 | 3/1976 | Fed. Rep. of Germany . | |
| 3301775 | 9/1983 | Fed. Rep. of Germany . | |
| 572388 | 6/1924 | France | 15/245 |
| 215124 | 5/1924 | United Kingdom . | |
| 372558 | 5/1932 | United Kingdom . | |
| 658331 | 10/1951 | United Kingdom . | |
| 1222538 | 2/1971 | United Kingdom | 15/245 |
| 1234375 | 6/1971 | United Kingdom . | |
| 1396559 | 6/1975 | United Kingdom . | |
| 2106583 | 3/1986 | United Kingdom . | |

*Primary Examiner*—Chris K. Moore

*Attorney, Agent, or Firm*—Kathleen A. Skinner

[57] ABSTRACT

An improved squeegee has a releasable clamping member mounted to the flared portion of the squeegee handle. A pivot pin is disposed in the clamping member in a position transverse to the handle, with the ends of the pin secured to fasteners mounted on opposite sides of the clamping member. The fasteners hold the flared portion of the handle and the back clamping plate which secures the support channel of the squeegee. When the position of the clamping member is shifted past its fulcrum point, the support channel is released for lateral movement.

12 Claims, 5 Drawing Figures

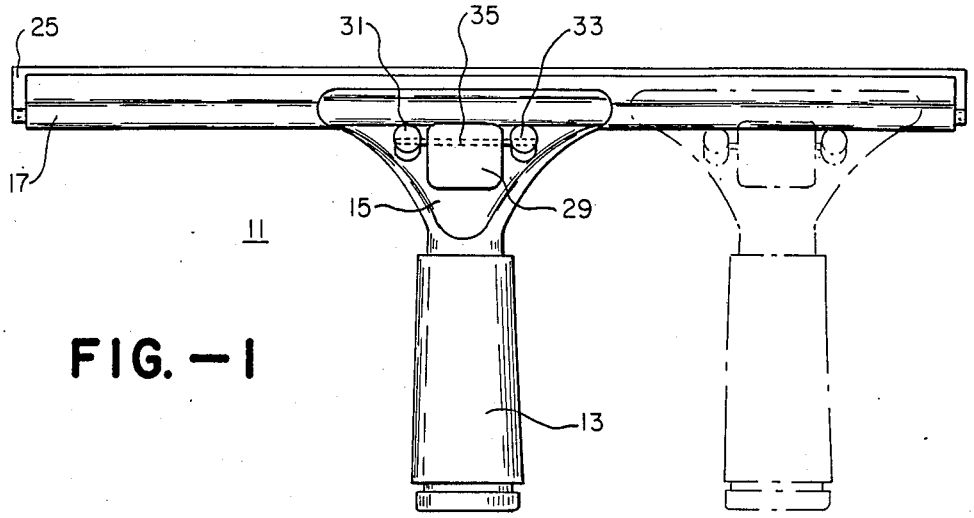
FIG.—1
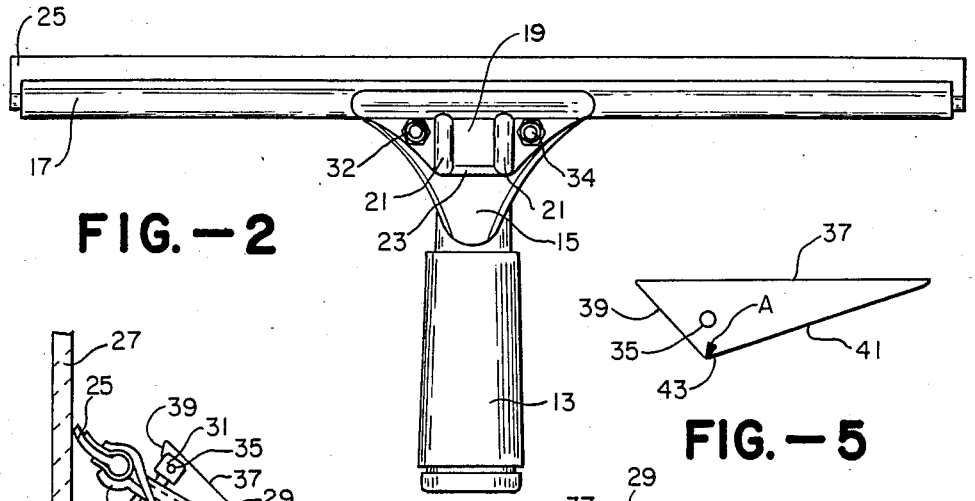
FIG.—2
FIG.—5
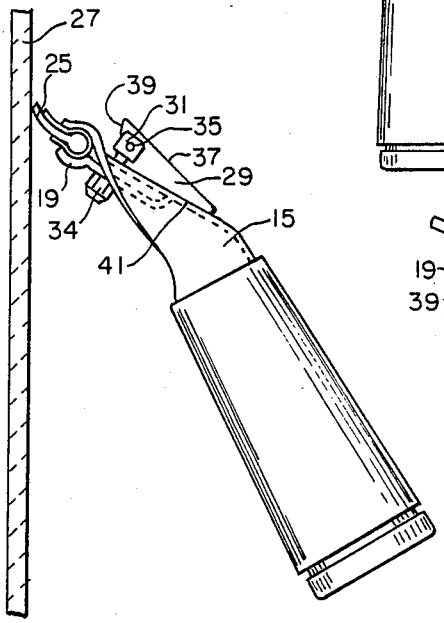
FIG.—3
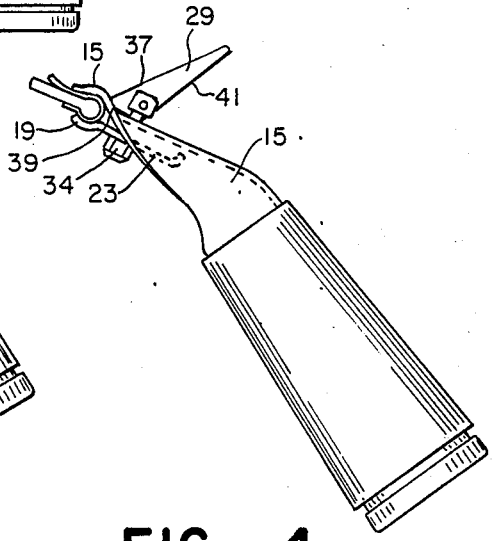
FIG.—4

SQUEEGEE

BACKGROUND OF THE INVENTION

1. Field of the Invention

The present invention relates to the field of cleaning implements and, more particularly, to an improved squeegee.

2. Description of the Prior Art

Squeegees are cleaning implements used for removing moisture from surfaces, especially windows. The surface to be cleaned is generally moistened and then wiped dry by applying the blade edge of the squeegee to the wet surface and drawing the blade under pressure along that surface, and the moisture along with it. One of the early professional squeegees is described in U.S. Pat. No. 2,123,638, issued Jul. 12, 1938, to Ettore Steccone. High quality squeegees still employ many of the features disclosed in that patent: a wiping blade held in a support channel which is secured by nuts and bolts to a flared portion of the handle of the squeegee.

An important requirement of a professional squeegee is the capability of sliding the support channel laterally and securing it in an asymmetrical position relative to the handle. Such positions are desirable for precisely cleaning corners and difficult to reach spots. Although it is possible to unscrew the bolts and nuts of the conventional squeegee, move the support channel and then retighten the screws, this procedure is awkward and cumbersome, and can be dangerous in the field, particularly for a window cleaner who is working at a high elevation or on a ladder.

Accordingly, there has been a need for a squeegee with a releasable clamping system to be operable in the field without requiring other tools. A number of attempts have been made to solve the problem, including prior art devices which hold the channel in place by means of a bolt secured by a wing nut, as illustrated in U.S. Pat. No. 3,110,052, issued to H. B. Whitman. Anchoring the channel at only one point is not quite as stable, however, as double bolts. The wing nut can also catch on materials or scratch surfaces, and if the wing nut is placed on top of the handle, it can irritate the user's hand, since many squeegee users control the squeegee by placing a finger on the flared portion of the handle. Another attempt to solve the problem of releasing the support channel is described in U.S. Pat. No. 3,892,005, issued to Berns. Although that device provides a releasable clamp which does not obstruct either the user's hand or the underside of the squeegee, the clamp is difficult to release with the use of only one hand and without the use of an additional tool. Other attempts have been made to provide for releasable clamps, but none allow single-handed operation as well as control and stability of use and a nonirritable surface for contact with the user's hand.

Thus, there has been a need for a squeegee having a releasable clamping means which can be released simply with a single hand which retains the stability and precision of the implement and also avoids irritating the hand during use. The present invention provides a solution to these problems in the prior art.

SUMMARY OF THE INVENTION

The present invention is an improved squeegee having a handle with a flared portion secured to the support channel of the squeegee. This improved squeegee has a clamping member, a pair of fasteners mounted in the squeegee handle and a pivot member connected to the fasteners. The clamping member may be moved with one hand about a fulcrum, causing the fasteners which secure the support channel to the handle of the squeegee to release the support channel for lateral movement.

OBJECTS OF THE INVENTION

It is therefore an important object of the present invention to provide a releasable clamping means for the squeegee which allows the wiping blade and channel of the squeegee to be held securely and precisely during use.

It is a further object of the present invention to provide a clamping means which can be easily released for movement or adjustment of the support channel without other tools.

It is another object of this invention to provide a releasable clamping means for a squeegee which will not irritate the hand of the user during its operation.

It is still another object of the invention to provide a squeegee having the above advantages while also being relatively easy to manufacture. Other objects and advantages of the invention will become apparent when it is considered in conjunction with the accompanying drawings described hereafter.

DESCRIPTION OF THE DRAWINGS

FIG. 1 is a front elevational view of the squeegee of this invention.

FIG. 2 is a rear elevational view of the invention shown in FIG. 1.

FIG. 3 is a side elevational view of the invention with the clamping means in closed or locked position.

FIG. 4 is a side elevational view of the squeegee of this invention with the clamping means in open or released position.

FIG. 5 is a side elevational view of the clamping member of this invention.

DESCRIPTION OF THE PREFERRED EMBODIMENT

The present invention is an improved squeegee having easily releasable clamping means. This improved squeegee 11 has many of the features of a conventional high quality squeegee. Such a squeegee includes a handle 13 with a flared, somewhat flattened, portion 15 which at its widest end is curved to correspond with the configuration of the support channel 17. A back clamping plate 19 fits under the flared portion of the handle and is also curved at its widest end to correspond with the shape of the support channel. The back clamping plate may have ridges 21, 21 and lower portion 23 curved toward the inside of the handle to increase the stability of the squeegee. A wiping blade 25, preferably made from rubber, has a beaded portion along its length. The blade is inserted longitudinally into the support channel, which has an inner tubular portion to conform to the wiping blade, and is anchored therein; for extra control it may be secured by metal clips to the inside of the support channel. The secure fit of these elements with each other allows the squeegee user to apply precise pressure to the surface to be cleaned, such as window 27.

The lower portion of the handle 13 is adapted for either mounting onto extension poles or use with the hand. As shown in these drawings, the lower portion of the handle may be covered with a sponge rubber or rubber sleeve for comfort and a better grip.

The improved squeegee 11 of the present invention includes releasable clamping means disposed on the flared portion 15 of the squeegee handle whereby the support channel 17 can be easily released for lateral movement relative to the squeegee handle. The releasable clamping means includes a clamping member 29, a pair of fasteners 31, 33 mounted in the squeegee handle and pivot means 35 connected to the fasteners.

The clamping member 29 of this improvement is generally triangular when viewed in cross-section, or from the side elevation (e.g., FIGS. 3, 4 and 5), although this shape could be varied somewhat. Clamping member 29 is mounted on the flared portion 15 of the squeegee handle between fasteners 31 and 33 and has a smooth inclined upper surface 37 for contact with the hand. It has a generally square or rectangular top plan configuration, although it can be any shape that will fit between the fasteners on the flared portion of the squeegee handle which does not project substantially above the lower portion of the flared portion 15 of the handle. The corners of the upper surface 37 of the clamping member are preferably rounded to avoid irritation with the user's hand and to prevent catching on chamois or other materials used with the squeegee. Surfaces 39 and 41 of the clamping member may contact the upper surface of the flared portion of the squeegee handle alternately. A fulcrum 43 is formed at the point where surfaces 39 and 41 join together. The lengths of these surfaces may vary, but surface 39 will preferably be of such a length that it fits against the flared portion of the handle so as not to interfere with other accessories which may be used with the squeegee or fitted over the channel-fitted portion of the squeegee handle. Surface 41, which may be more than twice as long as surface 39, is in general engagement with the flared portion 15 of the squeegee handle when the clamping member is in closed position. The corners formed by joining each of surfaces 39 and 41 with upper surface 37 are preferably also rounded for minimal irritation and contact. Although the configuration of the clamping member can vary somewhat, it has been found that a scalene triangle with surface 39 being shorter than surface 41 is preferred and that the angle A formed on the interior of the clamping member at the juncture of surfaces 39 and 41 is approximately 110°. It has been found that angle A and the length of surface 39 used in the preferred embodiment prevents the clamping member 29 from moving too far forward in the released position. If it moves too far forward it will allow the channel 17 to become too loose in the handle and possibly fall out. It should move forward only enough to release the channel 17 for adjustment but to still hold it in place. Limiting the forward movement also keeps the tip of the clamping member in reach of the thumb, thus making it easy to pull it back into the locked position with the one hand and its thumb. The clamping member can be made from any material but in the preferred embodiment, it is manufactured from a plastic or hard rubber material.

A pair of fasteners 31, 33 are also mounted in the flared portion 15 of the squeegee handle in opposed relation with the clamping member 29 disposed therebetween. The fasteners may be bolts or any slidable pins or studs. In the preferred embodiment of this invention, the fasteners are bolts with smooth, rounded heads and threaded ends upon which self-locking nuts 32, 34 are permanently secured, thus providing smooth surfaces above and below the squeegee handle. The nuts 34 can be used to adjust the clamping device to be either tighter or looser. These bolts are movably disposed between the flared portion 15 of the handle and the clamping plate 19 of the squeegee 11, securing the handle and plate tightly to the support channel 17 when the clamping member 29 is in closed position. The bolts move when the clamping member is moved about its fulcrum to its open position, thereby releasing the support channel for lateral movement. Apertures in the flared portion of the handle and the clamping plate receive the bolts with some allowance for movement of the bolts when the clamping means is released. When the clamping member is in open position, the support channel can be removed or slid laterally between the squeegee handle and clamping plate, but the fasteners prevent the clamping plate 19 from becoming detached from the squeegee handle.

The clamping means of the improved squeegee 11 of this invention also includes a pivot member connected to the fasteners 31, 33. In the preferred embodiment the pivot member includes a pivot pin 35 disposed transverse to the squeegee handle and secured in the clamping member 29. The ends of the pivot pin are mounted to the fasteners 31, 33, and are preferably secured in the heads of the bolts so that there are no rough edges exposed. The pivot pin, as illustrated by the phantom lines in FIG. 1, is disposed through the clamping member substantially parallel to the support channel 17 of the squeegee. It is eccentrically disposed in the forward portion of the clamping member; the forward portion of the clamping member being that portion closest to the support channel of the squeegee. The pivot pin can be sprung stainless steel piano wire. The use of sprung steel piano wire allows the clamping member 29 to move and flex from opened to closed position but yet adds tension to the mechanism in the locked position.

When the clamping member 29 of the squeegee 11 is in closed position, as illustrated in FIG. 3, the squeegee of this invention is a precision cleaning implement with the bolts 31, 33 fixed in place and tightly securing the support channel 17 between the flared portion 15 of the squeegee handle and the squeegee clamping plate 19. The squeegee user can change the lateral position of the support channel relative to the handle, in a single-handed operation, by using the thumb or forefinger to press the forward portion of the clamping member toward the support channel until the rear portion of the clamping member lifts up and is placed in its open position which is illustrated in FIG. 4. At that point the squeegee user can shift the channel, which is now loosely held in place, to a new position, by either tipping the squeegee in the direction the channel should move or lightly tapping it against a surface. The simple single-handed operation made possible by this invention is much safer and more efficient, especially for window cleaners balanced at high elevations.

The particular combination of features of this improved squeegee ensures that the position of the squeegee channel can be changed precisely and smoothly without wobbling, detachment or the need to use two hands and that it will also retain its stability and precision when the clamping means is in a clamped position. This squeegee provides features for maximum comfort of the user, since there are no irritating surfaces to interfere with or irritate and tire the user's hand. Furthermore, the squeegee of this invention can be easily manufactured since it uses so many features of the conventional squeegee. Thus, the present invention is an improved squeegee which solves the need for a releasable clamp means without loss of safety, efficiency, stability, precision or ease of use.

It will be seen that the above-described squeegee will achieve all the advantages and objects attributed to it, and while it has been described in detail, it is not to be limited to such details except as may be necessitated by the appended claims.

I claim:

1. In a squeegee having a handle with a flared portion and a gripping portion, a support channel holding the wiping blade of the squeegee, and clamping means securing said support channel to the handle, the improvement comprising said clamping means being releasable by a pivoting clamping member disposed on the upper surface of the flared portion of the squeegee handle and which can be actuated to either a released or locked position by downward pressure on the front or rear end of the clamping member, respectively, whereby the support channel can be easily partially released for controlled sliding lateral movement in said clamping means with respect to the squeegee handle, said clamping member in locked position having a smooth transition surface at the rear end thereof disposed proximate the gripping portion of the squeegee handle.

2. The improved squeegee of claim 1, wherein said clamping means further comprises a pair of movable fasteners mounted in the squeegee handle and engaging a movable clamping plate which grips said support channel, and a pivot member interconnecting said fasteners and journalling said clamping member whereby said clamping member can pivot to an unlocked position to partially release said support channel into a controlled but sliding condition.

3. The improved squeegee of claim 2, wherein the clamping member is generally triangular in cross-section and disposed between said fasteners with a relatively flat surface of the clamping member on top and its apex contacting the flared portion of the squeegee handle.

4. The improved squeegee of claim 2, wherein said pivot member includes a pivot pin disposed transverse to the squeegee handle and extending through said clamping member, the ends of said pivot pin being mounted to said fasteners whereby said fasteners are actuated when said pivot member is moved by said clamping member.

5. The improved squeegee of claim 2, wherein said clamping plate is disposed beneath the flared portion of the squeegee handle whereby the support channel is secured to said squeegee handle by being captured between said squeegee handle and said clamping plate, said movable fasteners moving said clamping plate toward said handle when said clamping member is actuated to the locked position.

6. In a squeegee having a handle with a gripping portion and a flared portion, a clamping plate disposed beneath the flared portion, and a support channel holding a wiping blade secured between the flared portion of said handle and said clamping plate, the improvement comprising a clamping member pivotally mounted on the upper surface of the flared portion of the squeegee handle which can be actuated to either a released or locked position by downward pressure on the clamping member, said clamping member having a flat upper surface providing a smooth transition surface proximate the gripping portion of the squeegee handle when the clamping member is in the locked position;

a pair of movable bolts extending through said squeegee handle and said clamping plate, said bolts having locking means to capture said clamping plate and the flared portion of said squeegee handle; and a pivot pin engaged with said clamping member, substantially parallel to the support channel with the ends of said pivot pin being secured to the heads of said bolts, said bolts being actuated by said clamping member as it is moved to a locked or released position to cause said clamping plate and said squeegee handle to secure or partially release said support channel.

7. The improved squeegee of claim 6 wherein said clamping member has a fulcrum on its lower portion, said fulcrum contacting the surface of the flared portion of the squeegee handle and the point of contact of said fulcrum with said handle being moved as said clamping member pivots to a locked or unlocked position and said pivot pin is eccentrically disposed in said clamping member.

8. The improved squeegee of claim 7 wherein said clamping member is disposed on said pivot pin between said bolts whereby when said clamping member is moved about its journal on said pivot pin to move the fulcrum to its open position the squeegee support channel is partially released for controlled lateral sliding movement relative to the clamping plate and handle of the squeegee.

9. The improved squeegee of claim 7 wherein said clamping member has a generally triangular configuration in cross-section with a relatively flat surface of said clamping member on top and its apex contacting the flared portion of the handle and said pivot pin is disposed in the forward portion of said clamping member.

10. The improved squeegee of claim 7 wherein the fulcrum of said clamping member has an internal angle of approximately 110° whereby the range of movement of said clamping member prevents the uncontrolled release of the support channel from the squeegee.

11. An improved squeegee comprising a support channel for holding a wiping blade, a handle having a flared portion proximate said support channel and a gripping portion, a clamping plate disposed beneath the flared portion of the squeegee handle whereby said support channel can be secured between said flared portion of the handle and said clamping plate, a clamping member mounted on the upper surface of the flared portion of the squeegee handle, said clamping member having a generally triangular configuration in cross-section with a flat upper surface providing a smooth transition surface proximate the gripping portion of the handle when the clamping member is in locked position, the apex of said clamping member forming a fulcrum in contact with the surface of the handle, a pair of movable bolts in opposed relation with said clamping member disposed therebetween, said bolts extending through said squeegee handle and said clamping plate and having self-locking nuts secured to the ends of said bolts and capturing said clamping plate and the flared portion of the squeegee handle, and a pivot pin eccentrically disposed through said clamping member in a plane substantially parallel to the support channel and secured at its ends to the heads of said bolts, whereby downward pressure applied to the forward end or rear end of the clamping member will cause it to pivot about its fulcrum to either a locked or unlocked position and to move said bolts to cause the clamping plate and squeegee handle to tightly secure or partially release said support channel from therebetween.

12. The squeegee of claim 11 wherein the pivot pin is disposed in the forward portion of said clamping member.

* * * * *